United States Patent [19]

Andrews et al.

[11] 4,003,569

[45] Jan. 18, 1977

[54] LAST COPY DETECTION

[75] Inventors: Donald Richard Andrews; Ralph Joseph Leclere, both of Boulder County, Ohio

[73] Assignee: International Business Machines Corporation, Armonk, N.Y.

[22] Filed: Nov. 28, 1975

[21] Appl. No.: 636,251

[52] U.S. Cl. ..... 271/259

[51] Int. Cl.[2] ..... B65H 7/02

[58] Field of Search ..... 271/258, 259, 173, 265; 340/259; 355/14

[56] References Cited

UNITED STATES PATENTS

| | | | |
|---|---|---|---|
| 3,618,936 | 11/1971 | Ziehm | 271/173 |
| 3,709,485 | 1/1973 | Acquaviva | 271/259 |
| 3,709,492 | 1/1973 | Baker | 271/173 |
| 3,905,594 | 9/1975 | Davis | 271/173 |

*Primary Examiner*—Richard A. Schacher
*Attorney, Agent, or Firm*—Herbert F. Somermeyer

[57] ABSTRACT

Minimum elapsed time between successive multiple copy nonoverlapped runs is achieved detecting the last copy as it exits from a paper path in any one of a plurality of exit locations. Means establish a last-copy watch for partially enabling the last-copy detector. Means indicate that the paper path leading to the exit is substantially clear of any copies and, finally, the trailing edge of the exiting document at a given one of said exit positions triggers the last-copy detector to signify that a new copy run condition is "go".

15 Claims, 1 Drawing Figure

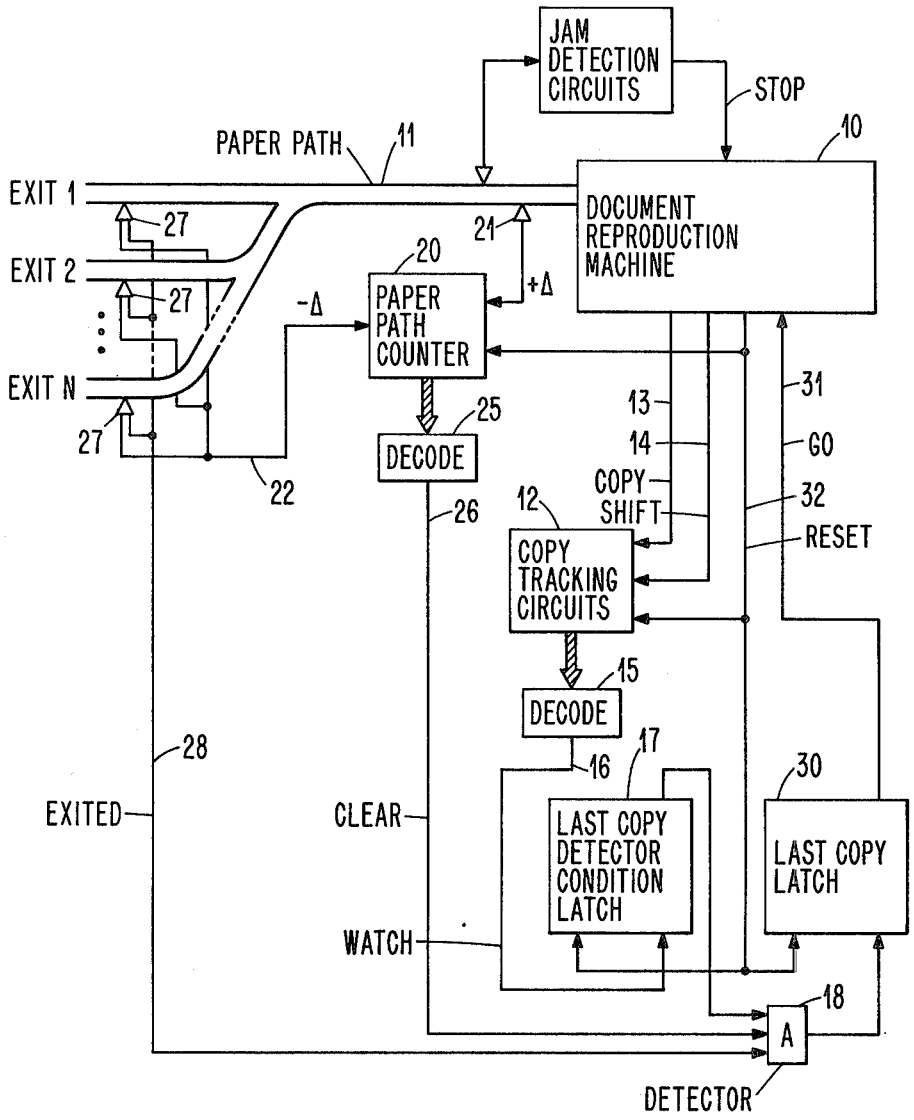
JAM DETECTION CIRCUITS
STOP
10
PAPER PATH
11
EXIT 1
EXIT 2
EXIT N
27
DOCUMENT REPRODUCTION MACHINE
21
20
PAPER PATH COUNTER
+Δ
-Δ
25
DECODE
22
26
13
14
COPY
SHIFT
12
COPY TRACKING CIRCUITS
31
GO
32
RESET
15
DECODE
16
17
LAST COPY DETECTOR CONDITION LATCH
30
LAST COPY LATCH
28
EXITED
CLEAR
WATCH
18
A
DETECTOR

LAST COPY DETECTION

BACKGROUND OF THE INVENTION

The invention relates to improvements in detecting the last copy of a multiply copy run from a document reproduction machine and, particularly, to a method for enhancing successive nonoverlapping multiple copy runs.

High-speed document reproduction machines often are operated with successive multiple copy runs. At an output portion of said machine, a collator stacker or other paper handling device receives the produced copies and directs them to an appropriate exit point. Such exit point may be a bin in a collator or stacker, a noncollate receiving tray, and the like. Particularly when a collator or stacker is used, the distance from a common paper path to the ultimate exit point for a given copy is variable. Therefore, the time elapsed for a copy to reach its ultimate destination is likewise variable.

It is desirable to make multiple copy runs nonoverlapping for facilitating jam recovery. By limiting the paper path, including the output portions, to a single multiple copy run, there is no need to determine which run is being executed at a given time nor to determine which copies from which run of a plurality of runs have been affected by the jam. Accordingly, it is desirable in maintaining cost control to keep the copies of a multiple copy run distinct and separate; and, for throughput considerations, it is highly desirable to minimize the time from the last copy of a given run, leaving the document reproduction machine to the time a new run is initiated.

SUMMARY OF THE INVENTION

This invention enhances apparatus for minimizing delay time between the last copy of one copy run and the first copy of a next succeeding run while maintaining high-quality recovery from paper jam conditions.

In accordance with the methodology of the present invention, a last copy is detected by establishing a last-copy watch signal followed by a paper path cleared signal and, finally, by an indication that the last copy has physically reached its ultimate destination. When the latter occurs, the next copy run is enabled to be started.

Apparatus employing the invention includes copy tracking circuits for initiating a watch for last-copy signal, which circuits indicate a desired paper path transport condition. Further, a paper path monitoring circuit which may be an up/down counter monitors the actual paper in the paper path and signifies when the paper path is clear. The paper path stops short of all exit points of the document reproduction machine. Each of the exit points has means for sensing a copy being exited and signifies same each time a copy is exited. The three indications are combined in a detector circuit for indicating that a given copy run has been terminated, and a new copy run can be initiated.

The foregoing and other objects, features, and advantages of the invention will become apparent from the following more particular description of a preferred embodiment thereof, as illustrated in the accompanying drawing.

THE DRAWING

The single FIGURE is a diagrammatic showing of a machine employing the methods and apparatus of the present invention.

DETAILED DESCRIPTION

Document reproduction machine 10, such as a convenience electrographic copier, supplies duplicate copies to a paper path 11 having a common portion leading to a plurality of exit points labeled exit 1, exit 2, . . . exit N. These exit points constitute output means of the document reproduction machine and may consist of a collator, stacker, etc.

The intermediate paper path 11 is monitored for paper jamming by jam detection circuits in combination with the copy tracking circuits 12. Details and interconnections are omitted for brevity. Jam detection circuits normally indicate a non-jam condition permitting document reproduction machine 10 to operate. Upon detecting a jam, a stop signal stops the machine interrupting document reproduction, thereby inhibiting detection of a last copy. When stopped, all circuits remain static. In a preferred form, copy tracking circuits 12 consist of a shift register which receives a copy signal over line 13 from document reproduction machine 10. The line 13 copy signal sets a stage of the shift register in circuits 12 to the active condition. The active condition is then shifted by a shift signal received over line 14 from document reproduction machine 10. If copy tracking circuits include an eight-stage shift register and five copies are being transported from document reproduction machine 10, then five stages will have the active condition with the five active conditions being shifted synchronously with the actual transport of the copies in paper path 11 toward the indicated exits. The active conditions of the shift register of copy tracking circuits 12 signify a desired paper copy transport status within path 11 and to the exit points 1-N. Toward the end of a multiple copy run, only those stages of the shift register in copy tracking circuits 12 at the terminal end of the shift register will be in the active state. For example, in an eight-stage shift register, when the last two stages are in the active state and the preceding six stages are in the inactive state, decode circuit 15 supplies an active signal over line 16 signifying that the last copy of a multiple copy run should be watched for to ensure early starting time of the next succeeding copy run. The line 16 signal sets last-copy detector condition latch 17 to the active condition memorizing the watch signal for the remainder of the immediate copy run. Latch 17 being in the active condition partially enables the last-copy detector AND circuit 18.

The paper path monitor, which is up/down counter 20, is incremented in the positive count direction by signals from paper path detecting switch 21. As the copies are transferred along paper path 11, exit switches 27 respond to leading edges of exiting copies to supply a signal over line 22 for decrementing paper path counter 20. Accordingly, the count at any time within counter 20 signifies the number of copies being transferred at that instant through paper path 11. In this regard, switch 21 is activated at the leading edge of a copy; while switches 27 are activated by the leading edge of a copy. Decode circuit 25 responds to paper path counter 20 having a zero count, or any other reference count, to supply an active signal over line 26 signifying that paper path 11 is clear of copies. The line 26 active signal additionally provides an enabling signal to last-copy detector AND circuit 18.

The last copy now is being transferred along one of the paper path branches toward one of the exits 1-N. Since only one exit is used at a given time and the arrangement in a constructed embodiment allowed only one copy to be resident between point 22 and the furthest exit point N, any copy exiting will indicate the last copy has left the machine. To this end, copy exit sensing switches 27 also detect the trailing edge of the exiting copy. The trailing edge indicating output signals from switches 27 are dot OR'd together on line 28 for actuating AND circuit 18 to the active condition. Of course, if the signals on lines 16 and 26 are inactive, AND circuit 18 does not respond. When actuated, AND circuit 18 immediately sets last-copy latch 30 which, in turn, supplies the memorized last-copy signal over line 31 as a "go" signal to document reproduction machine 10.

Document reproduction machine 10 may have several original document sources which can be automatically, semiautomatically, or manually processed for copy reproduction. In the automatic and semiautomatic feed, the "go" signal activates the feeding mechanism (not shown) for moving the original to a copy-making position which then institutes the next succeeding copy reproduction run. Document reproduction machine 10, in receiving the "go" signal on line 31, begins its next run by preparing the illustrated detection circuit for detecting the end of that next succeeding run. In this regard, an active signal from document reproduction machine 10 travels over line 32 resetting counter 20, copy tracking circuits 12, and latches 17 and 30.

Copy tracking circuits 12 may include an up/down counter in the similar manner that paper path counter 20 tracks the copies in paper path 11. It is preferred that the methodology of the invention, rather than being carried out by the illustrated circuits, be carried out by a microprogrammable processor wherein the paper path counter 20 is a programmed up/down counter, copy tracking circuits 12 constitute a computer program equivalent of a shift register or up/down counter, and the latches 17 and 30 are stages either in memory (local store) or special registers within a register (not shown). Such processor may also operate document reproduction machine 10. In this regard, the illustrated control circuits 20, 12, 17, and 30 can be a microcode routine executed in a multiprogramming environment with the programs operating the other portions of document reproduction machine 10.

Switches 27 indicate a leading edge by a contact closure and a trailing edge by contact opening. Suitable known electrical circuits identify a closure or opening of a single set of contacts.

While the invention has been particularly shown and described with reference to a preferred embodiment thereof, it will be understood by those skilled in the art that various changes in form and detail may be made therein without departing from the spirit and scope of the invention.

What is claimed is:

1. The method of indicating a last one of a successive train of articles being transported along a path from a receiving portion to a given exit location from a given entrance location, the steps of:

indicating a desired article transport status signifying approaching an end of a train of articles;

indicating that a predetermined portion including said receiving portion but excluding said exit location of said path is clear of said articles;

detecting and indicating that an article has exited from said path at said given exit location; and combining all of said indications to signify a last one article has exited said path.

2. The method set forth in Claim 1 further wherein said article can exit from any one of a plurality of exits, the further step of:

simultaneously sensing for exiting from all of said plurality of exits and indicating that an article has exited from said given exit location when an article is detected at any one of said exits.

3. The method set forth in claim 1 further including the step of:

supplying said combined indications as a "go" signal for starting a next succeeding train of articles in a nonoverlapped manner with a preceding train of articles.

4. The method set forth in claim 3 further including the steps of:

detecting said exiting article at any one of a plurality of exits and signifying said last one article irrespective of which exit said article exited.

5. A method of indicating a last copy in a train of successively transported copies traveling along a paper path, the steps of:

indicating that said paper path is clear of copies;

indicating a nonjam condition;

indicating that a copy has left said paper path each time a copy exits said path; and combining said indications to signify that said indicated exiting copy is a last copy.

6. A control for a document reproduction machine having a copy paper path with at least one exit and operable in a succession of copy runs predetermined runs having a plurality of successive copies in a train of copies means for enhancing nonoverlapping of copy runs, including in combination:

first means indicating a desired copy transport condition including means indicating a desired approach of a last copy of a given copy run to a given exit;

second means indicating actual copy transport condition over a predetermined portion of said paper path as having been cleared of copies;

third means sensing and having means indicating a copy has left said paper path at said given exit; and a last copy detector jointly responsive to all said indications to signify a last copy of a copy run has exited said paper path.

7. The control set forth in claim 6 wherein said paper path has a plurality of exits, further including in combination:

said third means including a separate sensing means at each of said plurality of exits and each sensing means having a separate one of said third means indicating means and said last-copy detector being responsive to any one of said separate sensing means.

8. The control set forth in claim 7 further including in combination:

separate means in each said first, second, and third means supplying said indications as electrical logic signals, respectively; and said last-copy detector being a logic AND circuit responsive to said first and second means and one of said third means indications to signify a last copy.

9. The control set forth in claim 8 further including means dot OR'ing said third means separate indicating means to supply a single third means indication to said last-copy detector.

10. The control set forth in claim 7 wherein said first means includes a shift register, said first means indicating means include decode means responsive to said shift register having predetermined signal content to supply said first means indication; and memory means electrically interposed between said first means for receiving and storing said first means indication and having means supplying a continuous first means indication to said last-copy detector.

11. The control set forth in claim 10 wherein:

said second means includes an up/down counter;

a first sensor in a first operative relationship to said paper path to increment said up/down counter in response to a copy;

a second sensor in a second operative relationship to said path in a predetermined juxtaposition to said exit and responsive to a copy for decrementing said up/down counter; and decode means in said second means indicating means detecting zero in said up/down counter to supply said second means indication to said last-copy detector.

12. The control in claim 11 wherein said path has a plurality of exits, each exit being displaced from said second sensor a distance independent of spacings between said second sensor and other ones of said exits;

said third means having a separate detector at each said exit; and said third means indicating means having an electrical conductor connecting all of said separate detectors in parallel circuit to said last-copy detector such that any one of said separate detectors can supply said third means indication.

13. The control set forth in claim 12 further including a last-copy memory responsive to said last-copy detector to set to an active condition and said last-copy latch supplying a "go" signal for indicating proceed with another copy run; and means to reset said memory and said first and second means to a reference state.

14. A document reproduction apparatus having a document reproduction machine signifying copies being delivered, image cycles and start of a copy run, paper path means taking said delivered copies and transporting same to one of a plurality of exits, said machine being capable of starting a copy run in response to an electrical "go" signal;

the improvement including in combination:

first means responsive to said signified copies being delivered and said image cycle for indicating delivered copies within said paper path including an approaching end of a train of copies by a watch signal;

second means indicating number of copies in a predetermined portion of said paper path including no copies by a clear signal;

third means indicating a copy being exited from any one of said plurality of exits; and means jointly responsive to said watch signal, said clear signal, and third means to exercise a nonoverlapping run control function over said document reproduction machine whereby said paper path has plural copies of one run only therein.

15. Apparatus set forth in claim 14 wherein said paper path means has different copy transport distances to said exits, respectively, via a plurality of branch paths; and said second means operatively associated with said paper path means only in other than said branch paths and said first means is operatively associated with all portions of said paper path means.

* * * * *